US006880173B2

(12) United States Patent
Green

(10) Patent No.: US 6,880,173 B2
(45) Date of Patent: Apr. 19, 2005

(54) WATERPROOF BOOT LINER

(76) Inventor: Solomon Green, 7631 Perth La., Riverside, CA (US) 92508

( * ) Notice: Subject to any disclaimer, the term of this patent is extended or adjusted under 35 U.S.C. 154(b) by 212 days.

(21) Appl. No.: 10/318,161

(22) Filed: Dec. 13, 2002

(65) Prior Publication Data

US 2004/0111787 A1 Jun. 17, 2004

(51) Int. Cl.[7] ..... A41D 13/00
(52) U.S. Cl. ..... 2/82
(58) Field of Search ..... 2/82, 242, 439, 2/46, 61, 240, DIG. 2

(56) References Cited

U.S. PATENT DOCUMENTS 2,741,770 A 4/1956 Tannen
3,747,125 A * 7/1973 Goldman et al. ..... 2/240
4,550,446 A 11/1985 Herman
4,967,494 A * 11/1990 Johnson ..... 36/9 R
5,325,541 A 7/1994 Willard
5,430,896 A 7/1995 Bisley
5,724,680 A * 3/1998 Cesnick et al. ..... 2/239

FOREIGN PATENT DOCUMENTS

GB 496046 5/1938

* cited by examiner

*Primary Examiner*—Tejash Patel
(74) *Attorney, Agent, or Firm*—Richard C. Litman

(57) ABSTRACT

A waterproof boot liner used to keep the feet dry in a wet or damp environment. The boot liner has halves that are mirror images of each other. The halves are joined along a seam by heat sealing or adhesives. The boot liner is held in place utilizing a ribbon of the same material used to make the halves. The boot liner is simply slipped over the socks and inserted into the boot and tied into placed by the wearer.

8 Claims, 1 Drawing Sheet

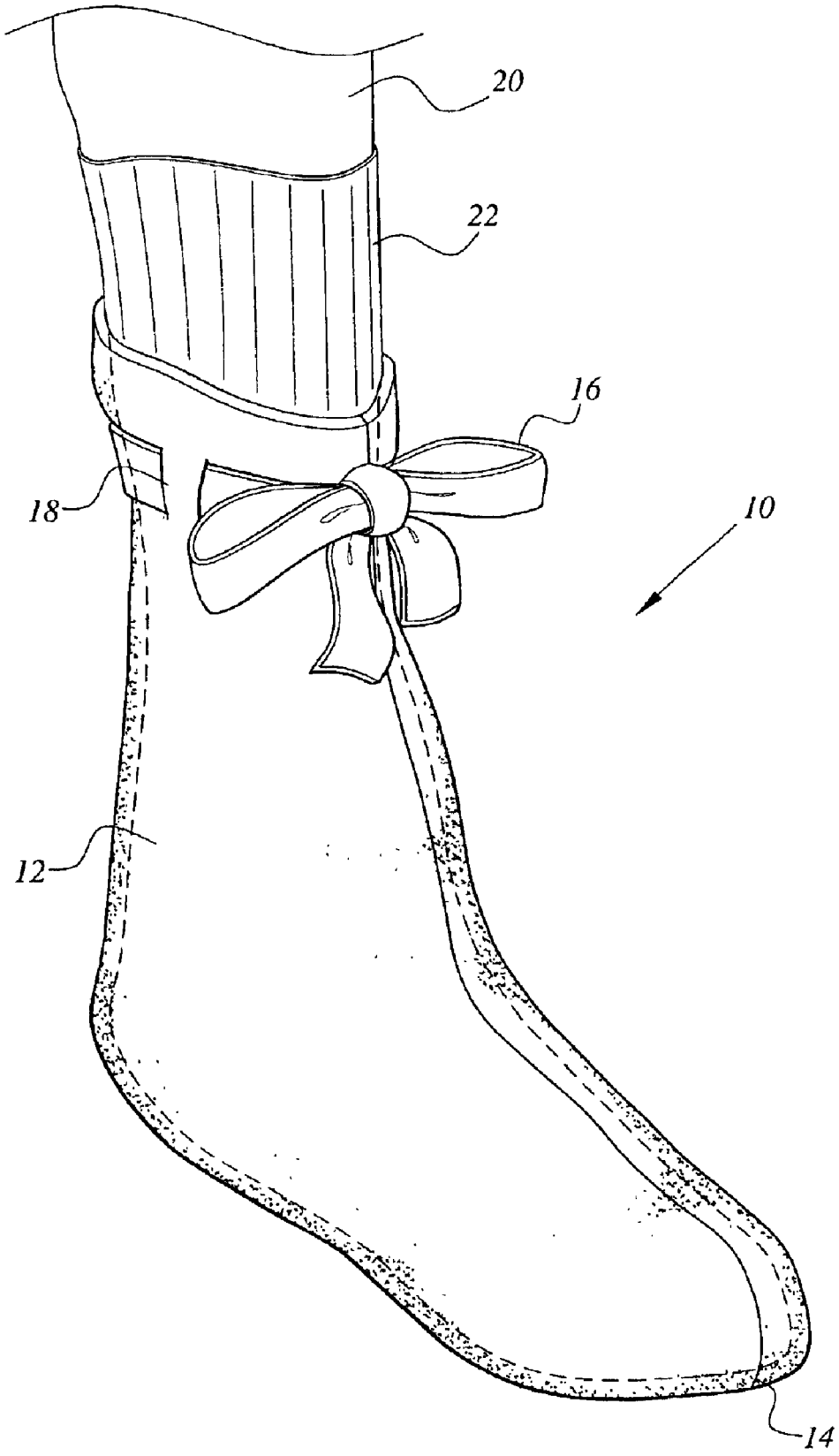
20
22
16
18
10
12
14

WATERPROOF BOOT LINER

BACKGROUND OF THE INVENTION

1. Field of the Invention

The present invention relates to a waterproof boot liner that prevents the wearer's feet from getting wet while wearing boots in a wet environment.

2. Description of the Related Art

There exists a need to protect a person's foot from moisture. Several others have attempted to solve this problem using various techniques, materials and structures. See U.S. Pat. No. 2,741,770 to Tannen, U.S. Pat. No. 4,550,446 to Herman, U.S. Pat. No. 5,325,541 to Willard and U.S. Pat. No. 5,430,896 to Bisley. Also see British patent 496,046 to Kissack et al. These designs are usually multi-layered or involve a complicated design.

None of the above inventions and patents, taken either singularly or in combination, is seen to describe the instant invention as claimed. Thus, a waterproof boot liner solving the aforementioned problems is desired.

SUMMARY OF THE INVENTION

The present invention is drawn to a waterproof boot liner that is worn over the socks to keep the feet dry when wearing work boots. The boot liner is constructed of two halves of a strong yet flexible vinyl material that is heat sealed or glued together to create a water tight seam that forms the boot liner. The boot liner is held in place by a ribbon of the same material tied around the leg of the user.

Accordingly, it is a principal object of the invention to keep the foot dry.

It is another object of the invention to create a boot liner that is lightweight and durable.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The sole FIGURE is an environmental, perspective view of a waterproof boot liner according to the present invention.

Similar reference characters denote corresponding features consistently throughout the attached drawings.

DETAILED DESCRIPTION OF THE PREFERRED EMBODIMENTS

The present invention is drawn to a waterproof boot liner 10 that is used to keep the foot and socks 22 dry while the user is wearing work boots or the like. The boot liner 10 is constructed of two halves 12 of four-gauge frosted vinyl, in a preferred embodiment. Obviously, other materials meeting the requirements of the preferred material could be employed.

The two halves 12 are mirror images of each other. Although other materials can be used for the boot liner 10, four-gauge frosted vinyl has been found to be durable, flexible, comfortable and inexpensive. The halves 12 are attached to each other by heat sealing or by applying adhesives (hot or cold) along a seam 14. This makes the seam 14 watertight and resistant to pulling apart.

The boot liner is held in position by a fastener 16 that is a ribbon of the same material that the halves 12 of the boot liner 10 are constructed from. The fastener 16 is inserted through slits 18 that are in an upper portion of the boot liner 10 and tied around the sock 22 and leg 20 of the user. This holds the boot liner 10 in placed in the boot. The boot liner 10 can be utilized with any footwear that is worn in a wet or damp environment.

It is to be understood that the present invention is not limited to the embodiments described above, but encompasses any and all embodiments within the scope of the following claims.

I claim:

1. A waterproof boot liner comprising:

a first flat form and a second flat form, said first flat form and said second flat form being identical to each other, each said first and second flat forms made of four-gauge frosted vinyl and having a perimeter, said perimeter defining a predetermined shape including at least a top edge with first and second ends, a heel portion, and toe portion;

a watertight seam formed between said first flat form and said second flat form along said perimeter beginning at said first end, around said heel portion and said toe portion, and ending to said second end, whereby an open top is formed between said top edges of said first and second forms;

each said first and second forms defining a plurality of uniform slits disposed adjacent said open top; and a fastener disposed in said slits, so as to be interleaved through said slits around said open top.

2. The waterproof boot liner of claim 1, wherein the seam is created by heat sealing the halves together.

3. The waterproof boot liner of claim 1, wherein the seam is created by using an adhesive.

4. The waterproof boot liner of claim 1, wherein the fastener is a ribbon of material, the material being four-gauge frosted vinyl.

5. A method of fabricating a waterproof boot liner comprising the steps of:

forming a first flat form from four-gauge frosted vinyl, the first flat form having a perimeter defining a top edge having a first and second end, a heel portion, and a toe portion;

forming a second flat form from four-gauge frosted vinyl, the second flat form having a perimeter defining a top edge having a first and second end, a heel portion, and a toe portion;

the first flat form and the second flat form being identical to each other, and each flat form having a plurality of uniform slits disposed near the top edge;

aligning the perimeters of the first and second flat forms together;

providing a watertight seam along the aligned perimeters beginning at the aligned first end of the aligned top edges, around the aligned heel portion and aligned toe portion, and ending at the aligned second end, whereby an opened top is formed between the aligned top edges; and providing a fastener disposed in the slits, such that the fastener is interleaved through the slits about the opened top.

6. The method of claim 5, further comprising the step of:

heat sealing the aligned perimeters together to form the seam.

7. The method of claim 5, further comprising the step of:

adhesively attaching the aligned perimeters together to form the seam.

8. The method of claim 5, further comprising the steps of:

forming the fastener of four-gauge frosted vinyl material; and shaping the fastener as a ribbon of the four-gaug frosted vinyl material.

* * * * *